US006681753B2

(12) United States Patent
Afshari

(10) Patent No.: US 6,681,753 B2
(45) Date of Patent: Jan. 27, 2004

(54) SHAFT CLAMPING ARROW REST

(76) Inventor: Abbas Ben Afshari, 4 Landing Way, Channel Cove, Biddeford, ME (US) 04005

( * ) Notice: Subject to any disclaimer, the term of this patent is extended or adjusted under 35 U.S.C. 154(b) by 0 days.

(21) Appl. No.: 10/121,123

(22) Filed: Apr. 11, 2002

(65) Prior Publication Data

US 2003/0192520 A1 Oct. 16, 2003

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | | |
|---|---|---|---|---|---|
| 3,342,173 | A | | 9/1967 | Ferguson | |
| 4,407,261 | A | * | 10/1983 | Elliott | |
| 4,676,220 | A | | 6/1987 | Pietraszek | |
| 4,685,439 | A | * | 8/1987 | Cosentino | |
| 5,415,154 | A | | 5/1995 | Angeloni | |
| 5,503,136 | A | | 4/1996 | Tone | |
| 5,606,961 | A | | 3/1997 | Basik et al. | |
| 5,632,263 | A | * | 5/1997 | Sartain | 124/44.5 |
| 5,676,121 | A | | 10/1997 | Bizier | |
| 5,722,381 | A | | 3/1998 | Mizek | |
| 6,021,769 | A | | 2/2000 | Troncoso | |
| 6,044,832 | A | * | 4/2000 | Piersons | 124/44.5 |
| 6,082,348 | A | | 7/2000 | Savage | |
| 6,202,635 | B1 | * | 3/2001 | Evans | 124/44.5 |

* cited by examiner

*Primary Examiner*—John A. Ricci
(74) *Attorney, Agent, or Firm*—Morriss O'Bryant Compagni, P.C.

(57) ABSTRACT

An arrow rest comprises an arrow rest support arm pivotally mounted to the riser of a bow. The support arm is coupled to a cable guide of the bow through linkage that causes the support arm to rise relative to the riser of the bow as the cable is drawn to launch an arrow. As the cable is released to launch an arrow, the arrow rest drops to allow the fletching to pass the arrow rest without contact. In addition, as the arrow rest moves from a first resting position to a second pre-launch position and back again, a clamping mechanism grasps the shaft of the arrow when the support arm is in the resting position. As the support arm moves to the pre-launch position, the clamping mechanism releases the shaft of the arrow so that the arrow can be freely launched from the support arm without interference from the clamping mechanism.

54 Claims, 11 Drawing Sheets

SHAFT CLAMPING ARROW REST

BACKGROUND

1. Field of the Invention

The present invention relates to an apparatus for supporting the shaft of an arrow when launched from an archery bow. More particularly, the present invention relates to an arrow rest that can move from a first, resting position to a second ready position as the sting of the bow is drawn to a firing position. In the resting position, the arrow rest holds the shaft of the arrow relative to the arrow rest. In the ready position, the arrow rest supports the shaft of the arrow but no longer clamps the shaft of the arrow to allow the arrow to freely launch from the arrow rest.

2. Description of the Prior Art

Over the past few decades, the interest in the sport of archery in the United States has significantly increased. In particular, the number of sportsmen and sportswomen who hunt using a bow has continued to rise. As a result of this growth, the number of archery products manufacturers and the development of new archery products has greatly expanded.

For many years, recurve bows were the only kind of bow available. Once the compound bow was introduced, the interest in and, naturally, the number of accessories for compound bows increased. Such accessories include various types of sighting apparatuses, stabilizing devices, vibration dampening device and arrow rests for supporting the shaft of the arrow when an arrow is drawn prior to launching. The first arrow rests typically comprised a V-shaped tab of plastic that was attached to the riser of the bow. With such devices, the shaft of the arrow rests within the V of the arrow rest while the archer aims the bow toward a target. It was discovered that the friction between the shaft of the arrow and the arrow rest and/or the contact between the arrow rest and the feathers or fletching on the aft end of the arrow can effect the trajectory and direction of flight of the arrow.

To address this problem, many arrow rests are formed from a flexible material, such as plastic. By using a flexible material, the arrow rest can deflect out of the way when the arrow is launched from the bow. Such a plastic arrow rest, however, has its drawbacks. For example, the plastic tab arrow rest typically deflects in a direction transverse to the direction of flight of the arrow. As such, contact between the fletching of an arrow and the arrow rest can still effect the flight of the arrow.

In order to provide a more stable support for an arrow and to allow the arrow rest to flex away from the shaft in the direction of the flight of the arrow, arrow rests have been developed that include a pair of arms. The tips of the arms support the shaft of the arrow. The arms are typically attached to or integrally formed with a rotatable shaft that is rotatably mounted to a mounting bracket. The mounting bracket is configured for attachment to the riser of a compound bow. In addition, the shaft is biased relative to the mounting bracket so that the arms are biased toward the shaft of an arrow when the arrow is resting upon the tips of the arms. The biasing of the arms is provided by a coil spring interposed between the mounting bracket and the rotatable shaft.

When an arrow is launched from a bow utilizing such an arrow rest, the impact of the fletching of the arrow upon the arms of the arrow rest will cause the arms to rotate downwardly. After the fletching pass the arms, the coil spring then causes the arms to rotate back to their pre-launch position. This contact between the fletching and the arrow rest can effect the trajectory of the arrow by applying drag, and/or torque to the shaft of the arrow as the arrow is released.

Muzzy Products Corp. in Georgia has attempted to provide an arrow rest that eliminates the effects of the arrow rest on the flight of the arrow. In the Muzzy device, the arrow rest lifts the shaft of the arrow to a pre-shoot position at full draw and falls away as the arrow is released. The arrow rest rises from a resting position to a pre-launch position by being coupled between the riser and the cable slide. The arrow rest is coupled between the riser and the cable slide with a pair of arms that are pivotally connected to one another and to the riser and cable slide. As the bow is drawn to a pre-launch position sliding the cable guide along the cable guard away from the riser, the pair of arms straighten relative to one another. As the pair of arms straighten, the arrow rest rises relative to the riser. When the arrow is released, the action of the cable causes the cable guide to slide back to its resting position. The movement of the cable guide back to its original position causes the arrow rest to drop.

Another example of a "fall-away" arrow rest is manufactured by Trophy Taker of Montana. The arrow rest is coupled to the riser and tide with a tether to the cable of the bow. The arrow rest is actuated from a resting position to a pre-launch position at full draw by the pull on the tether generated by the cable. As tension is applied to the tether, the arrow rest is caused to be rotated from a first position to a second position that raises the shaft of the arrow. As the arrow is released, the tension on the tether is removed and the arrow rest is allowed to drop by rotation of the arrow rest relative to the riser. Such fall-away arrow rests, while attempting to resolve some of the problems caused by arrow rests, do not address a significant disadvantage of all arrow rests.

When an archer draws an arrow along the arrow rest, one hand grasps the grip of the bow and the other draws the cable. The shaft of the arrow rests on the arrow rest but is otherwise unsupported along its length. As most arrow rests provide a V-shaped notch for supporting the shaft of the arrow or a pair of arms whose tips support the shaft therein between, any sudden movement of the bow can cause the shaft of the arrow to fall from the arrow rest. Often times, such the shaft of the arrow falls from the arrow rest when an archer has pulled the cable to a full draw, but decides to controllably return the cable to its resting position without launching the arrow. Because of the jerking force of such a maneuver, the archer is often unable to maintain the shaft of the arrow on the arrow rest. As the arrow falls, it may impact the riser of the bow generating a noise that can startle game.

In a hunting setting, noise is a major factor in the ability to stalk an animal. Hunters take great strides to maintain silence in the wild so as to not startle the game. As most hunters will attest, the "clanking" of the shaft of a falling arrow against the riser is sure to startle most game causing the animal to flee.

The Muzzy device attempts to address this issue by providing a relatively large V for supporting the shaft of the arrow. Even with the Muzzy device, however, an archer is not likely to be able to move through underbrush with a loaded arrow without the arrow falling from the arrow rest.

Another example of an arrow rest that prevents the shaft of the arrow from falling from the arrow rest is comprised of a cylindrical aperture supporting a plurality of inwardly extending bristles that form a small opening in the center of the bristles for supporting the shaft of the arrow. As the arrow is launched, the fletching can pass through the bristles.

The bristles, however, tend to tear the fletching from the shaft of the arrow.

Thus, it would be advantageous to provide an arrow rest that is capable of grasping the shaft of the arrow when the arrow is at a resting position and freely supporting the shaft of the arrow when the bow is at full draw. It would also be advantageous to provide such an arrow rest that falls away as the arrow is launched to eliminate effects of the arrow rest on the flight and/or fletching of the arrow.

SUMMARY OF THE INVENTION

These and other advantages will become apparent from a reading of the following summary of the invention and description of the illustrated embodiments in accordance with the principles of the present invention.

Accordingly, an arrow rest comprises an arrow rest support arm pivotally mounted to the riser of a bow. The support arm is coupled to the cable guide of the bow through linkage that causes the support arm to rise relative to the riser of the bow as the cable is drawn to launch an arrow. As the cable is released to launch an arrow, the arrow rest drops to allow the fletching to pass the arrow rest without contact.

As the arrow rest moves from a first resting position to a second pre-launch position and back again, the support arm is provided with a clamping mechanism that grasps the shaft of the arrow when the support arm is in the resting position. As the support arm moves to the pre-launch position, the clamping mechanism releases the shaft of the arrow so that the arrow can be freely launched from the support arm without interference from the clamping mechanism. As the cable is released and the cable guide returns to its resting position, the support arm also returns to its resting position. As the support arm moves from the pre-launch position to the resting position, the clamping mechanism closes relative to the support arm so as to be able to grasp the shaft of an arrow.

The clamping mechanism is comprised of a flexible or rigid material that allows the shaft of an arrow to be inserted into the clamping mechanism while it is in a closed position.. The clamping mechanism, however, prevents the shaft of the arrow from being dislodged from the clamping mechanism until the cable of the bow is drawn an amount sufficient to open the clamping mechanism.

The clamping mechanism may be actuated by contacting the shelf of the riser or an overdraw shelf as a secondary shelf such that the clamping mechanism closes upon contacting the shelf. The clamping mechanism is biased into an open position so that as the clamping mechanism rises relative to the shelf of the riser, the clamping mechanism automatically opens.

Likewise, the clamping mechanism may be actuated by gear-type arrangements that cause the clamping mechanism to open and close around the shaft.

It is also contemplated that the shaft of the arrow may be removed from the clamping mechanism by a secondary arrow rest support that rises to remove the shaft of the arrow from the clamping mechanism as the cable is drawn.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it bing understood, however, that the invention is not limited to the specific methods and instruments disclosed. In the drawings.

DETAILED DESCRIPTION OF THE PREFERRED EMBODIMENTS

Figure 1A:
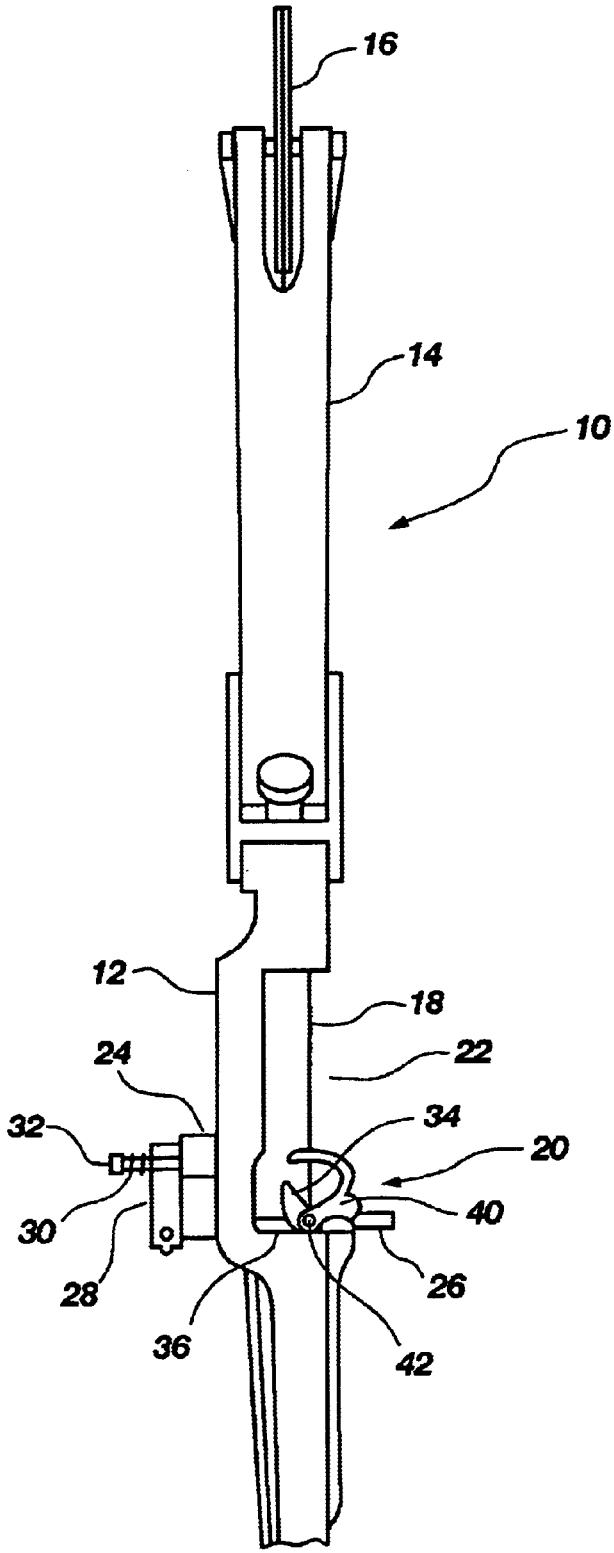
FIG. 1A is a partial front view of a compound bow with a first embodiment of an arrow rest attached thereto in accordance with the principles of the present invention.

Referring to the drawings, FIG. 1A illustrates a compound bow, generally indicated at 10, to which an arrow rest assembly, generally indicated at 20 is, is attached. The compound bow comprises a typical bow assembly having a riser 12 and an upper limb 14 to which an upper pulley or cam is rotatably attached. A cable 18 is provided for launching an arrow (not shown). It should be noted, however, that while the bow 10 is illustrated as having a particular configuration, the arrow rest 20 of the present invention could be adapted to be attached to and function with any compound bow in the art as well as those developed in the future.

The riser 12 of the bow 10 defines a laterally offset portion 22 through which the arrow is launched. The offset portion 22 allows the cable 18 to be in generally vertical alignment with the limb 14 and the remainder of the riser 12 while providing a channel or window to allow positioning of an arrow therein while maintaining proper alignment of the arrow relative to the cable 18 for launching. The arrow rest 20 is positioned within the offset portion 22 of the riser 12 so as to hold the arrow in proper alignment with the cable 18.

The arrow rest 20 is comprised of a mounting bracket 24 mounted to the riser 12 of the bow 10. A rotatable shaft 26 is coupled to the mounting bracket 24 and attached to a pivotable member 28. The pivotable member 28 is linked to the cable guide (not visible) such that movement of the cable guide causes pivoting of the pivotable member 28 and corresponding rotation of the rotatable shaft 26. The pivotable member 28 is biased relative to the mounting bracket 24 as with coil spring 30 attached to post 32. An arrow rest support arm 34 is attached to the shaft 26 such that rotation of the shaft 26 causes the support arm 34 to pivot. The pivotable member 28 is biased in a direction that forces the support arm 34 toward the shelf 36 of the riser.

The arrow rest 20 is provided with a clamping member 40 that is coupled to the support arm 34. In the resting position as shown, the clamping member 40 extends over the support arm so as to clamp the shaft of an arrow relative to the support arm 34. The clamping member 40 can rotate relative to the support arm 34 about its attachment point 42.

Figure 1B:
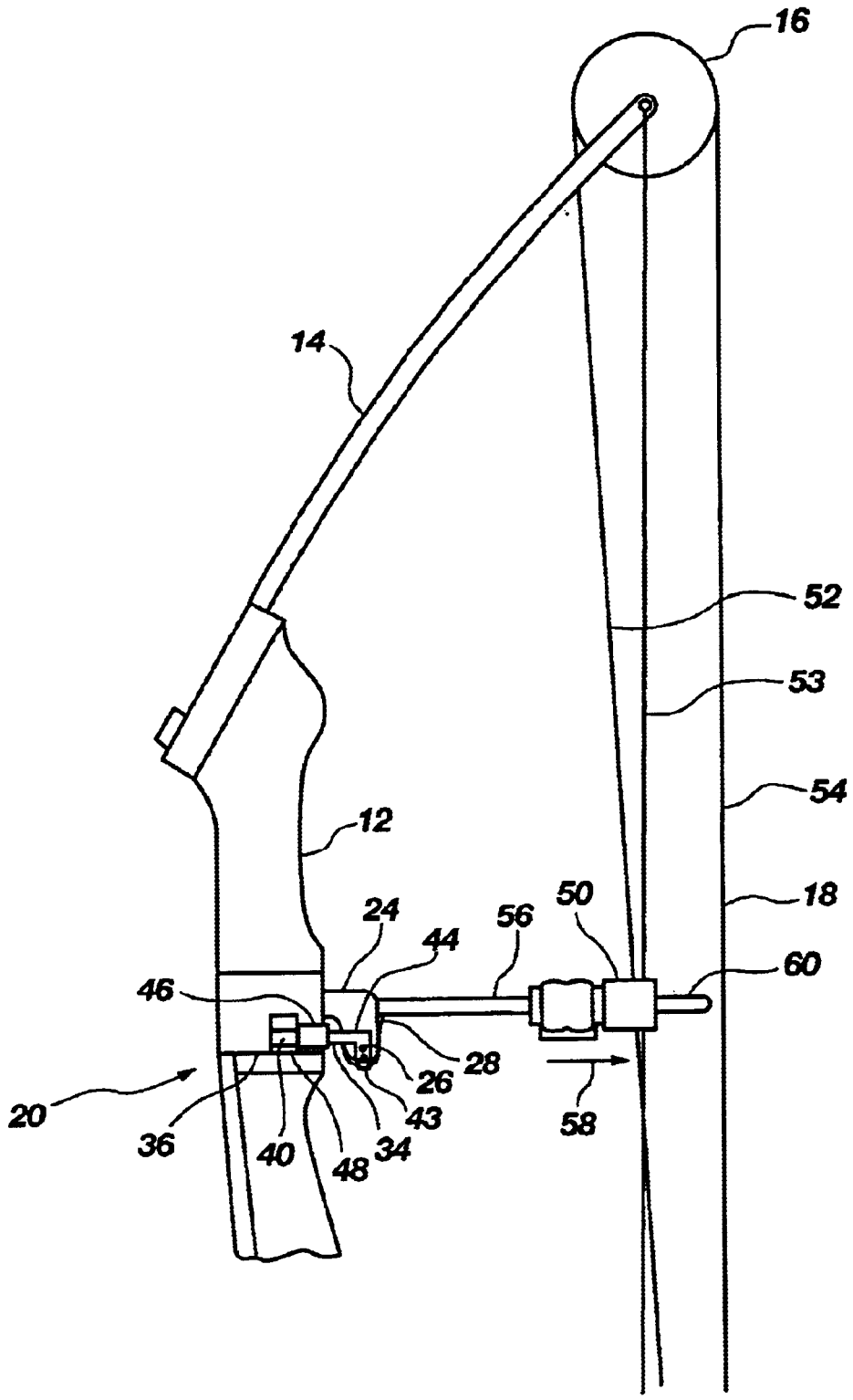
FIG. 1B is a partial first side view of the compound bow and arrow rest shown in FIG. 1A.

As further illustrated in FIG. 1B, the mounting bracket 24 extends behind the riser 12 and is fixedly attached thereto. The support arm 34 is pivotally coupled to the mounting bracket 24 with the rotatable shaft 26 that fits within the arm 35 and is rigidly held relative thereto with a set screw 43. As the pivotable member 28 pivots relative to the mounting bracket rotating the rotatable shaft 26, the arm 34 to rises off of the shelf 36 from a resting position as shown to a pre-launch position above the shelf 36. The arm 34 is comprised of a first arm portion 44 that may be formed of a rigid material such as metal or a harder plastic and a second portion 46 that may be formed from a softer material such as rubber or a softer plastic. The first portion 44 provides structural support for the second portion and is capable of resisting damage from the forces encountered by the returning to or being present at the resting position.

The shaft of an arrow rests on the second portion 46. Because the arm 34 returns to its resting position as the arrow is launched, it is not necessary to form the second portion 46 from a friction limiting material such as TEFLON or the like. That is, because the arrow does not slide to any substantial degree along the second portion 46 as the arrow is launched, it is not necessary to form the second portion 46 from a slick material as is commonly used on other types of arrow rests known in the art that maintain contact with the shaft of the arrow as the arrow is launched.

The clamping member 40 forms part of a clamping mechanism for grasping the shaft of the arrow when the arrow rest is in the resting position. As the arm 34 is lifted, the clamping member 40 opens to release the shaft of the arrow.

Whether launched or simply controllably returned to the resting position, the engagement of the clamping member 40 with the shelf 36, or more particularly with a clamping member abutment structure 48, causes the clamp to close relative to the second portion 46. Because the clamping member 40 is formed from a flexible material such as a softer plastic or rubber material, the shaft of an arrow can be inserted between the clamping member 40 and the second portion 46 by slightly flexing open the clamping member 40 to allow passage of the shaft of an arrow therein.

Actuation of the arrow rest 20 is controlled by coupling or linking the arrow rest 20 to the cable slide 50. The cable slide 50 is commonly found on compound bows but is primarily used to position the cable spans 52 and 53 from lying in the same vertical plane as the primary cable portion 54 that is used to launch an arrow. That is, the cable spans 53 and 54 are moved to one side or offset from the vertical plane defined between the primary cable portion 54 and the arrow rest 20 so as to provide clearance for the shaft and fletching of an arrow. The cable slide 50 slides along a cable guide 56 that is rigidly secured relative to the riser 12.

The cable guide 56 is comprised of an elongate shaft attached to the mounting bracket 24. In a typical compound bow, the cable guide 56 is attached directly to the riser 12 at a position above the vertical location of the arrow rest relative to the riser. By moving it to the mounting bracket, the cable slide 50 is positioned in alignment with the arrow rest 20 for allowing a substantially horizontal linkage between the arrow rest and the cable slide 50.

As the primary cable portion 54 is drawn, the cable slide 50 will move in the direction of the arrow 58 toward the proximal end 60 of the cable guide 56. That is, as the cable portion 54 is pulled away from the riser 12, the end of the limb 14 containing the pulley 16 will flex away from the riser 12 causing the cable spans 52 and 53 to also move away from the riser 12 so as to maintain their vertical orientation between the upper and lower pulleys or cams. By linking the pivotable member 28 to the cable slide 50 at a position spaced from its center of rotation, the movement of the slide 50 away from the riser will cause a corresponding rotation of the pivotable member 28. Also, because there is tension between the pivotable member 28 in a direction toward the riser 12 a cable slide stop 62 is provided on the cable guide 56. The cable stop 62 properly position the cable slide 50 relative to the cable guide 50 so as to maintain substantial vertical alignment of the cable spans 52 and 53, that is without pulling the cable spans 52 and 53 toward the riser 12, when the cable 18 is returned to a resting position as shown.

Figure 1C:
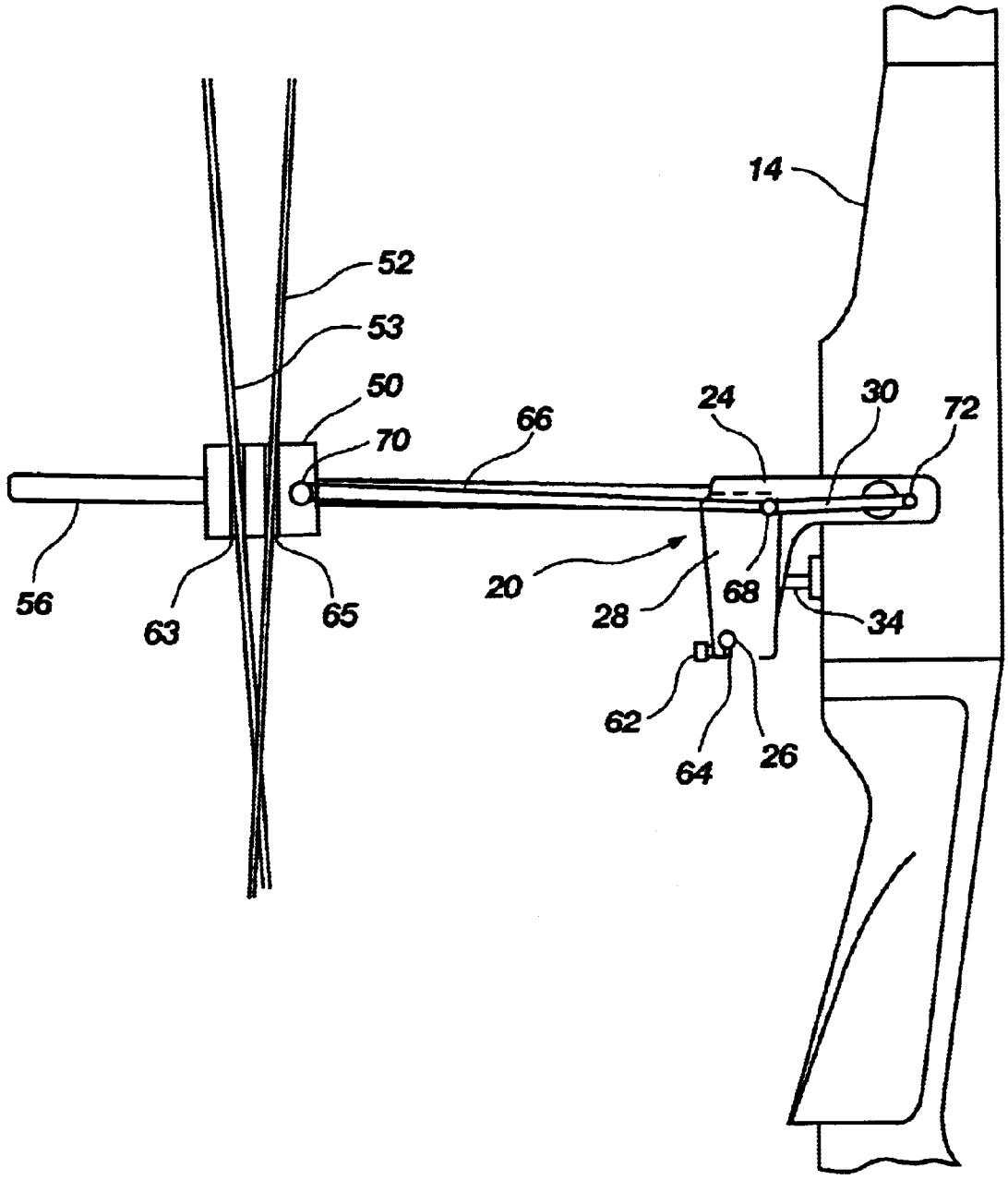
FIG. 1C is a partial second side view of the compound bow and arrow rest shown in FIG. 1A.

As shown in FIG. 1C, the pivotable member 28 is rotatably coupled to the mounting bracket 24 with the rotatable shaft 26. The shaft 26 is fixedly held relative to the pivotable member 28 with a set screw 62 that spans a slot 64 defined by the pivotable member 28. The shaft 26 can rotate relative to the mounting bracket 24 as by passing through a transversely extending bore through the mounting bracket 24 that may be lined with a plastic or other type of bushing or bearing surface to allow free rotation of the shaft 26 relative to the mounting bracket 24. Of course, in a simpler version, the shaft could be integrally formed with the pivotable member by forming an L-shaped member with one leg of the L-shaped member rotatably coupled to the mounting bracket 24 and the other leg pivoted to rotate the first leg.

The pivotable member 28 is linked to the cable slide 50 with a biasing member 66. The cable slide 50 is provided with a pair of slots 63 and 65 for receiving and laterally engaging with the cable spans 52 and 53. Thus, the cable slide 50 moves along the cable guide 56 as the cable spans 52 and 53 move away from the riser 12 as the cable is drawn. The biasing member is held relative to the pivotable member 28 and the cable slide 50 by engagement with a pair of posts 68 and 70 or threaded fasteners with an exposed portion for wrapping of the biasing member 66. In this embodiment, the biasing member 66 is comprised of an elastic cord that allows for a certain amount of stretching of the cord before becoming taut. This amount of stretch provides a slight delay in the actuation of the pivotable member 28 relative to movement of the cable slide 50. This allows for a small amount of pre-draw to be placed on the cable without causing actuation of the clamping mechanism of the arrow rest 20. This also causes the clamping mechanism to return to its resting position before the cable returns to its resting position as the arrow is launched. That is, the arrow rest 20 returns to the resting position ahead of the cable to allow the arrow rest to move out of the way as the fletching of the arrow passes the arrow rest 20.

A second biasing member 30 is coupled between the post 68 and a second post 72 or threaded fastener secured to the mounting bracket 24. The second biasing member 30 is provided to cause the arm 34 to move to the resting position as shown when the cable slide 50 is also in the resting position. The second biasing member may be comprised of one or more coil springs that engage the posts 68 and 72 to create a bias between the mounting bracket 24 and the pivotable member 28. The spring force of the second biasing member is configured to be greater than the spring force of the first biasing member 66 so as to pull the first biasing member 66 and the cable slide 50 toward the riser 14 as the cable is released when launching an arrow. As the cable slide 50, however, returns to its resting position, the first biasing member 66 returns to its stretchable state while maintaining some amount of tension between the pivotable member 28 and the cable slide 50 without overpowering the second biasing member 30.

The second biasing member 30 also provides an additional benefit to the ballistics of the bow itself. That is, the biasing force applied by the second biasing member 30 through the first biasing member when it is taut to the cable slide 50 increases the firing speed of the bow. Thus, the bow will actually shoot an arrow at a higher velocity with the arrow rest 20 of the present invention.

Figure 2A:
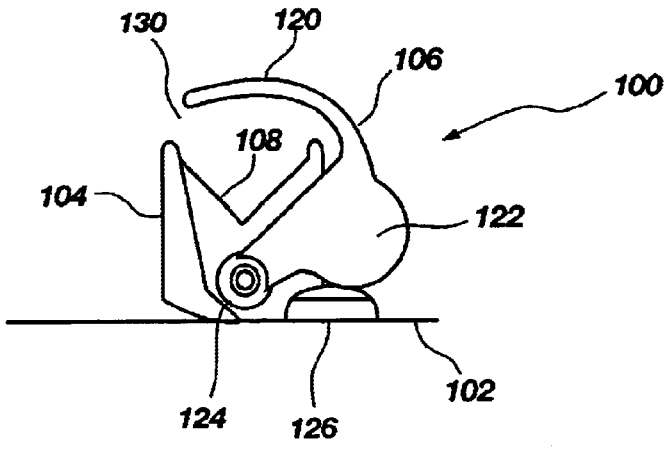
FIG. 2A is an end view of a first embodiment of a clamping arrow rest in a first resting position in accordance with the present invention.
Figure 2B:
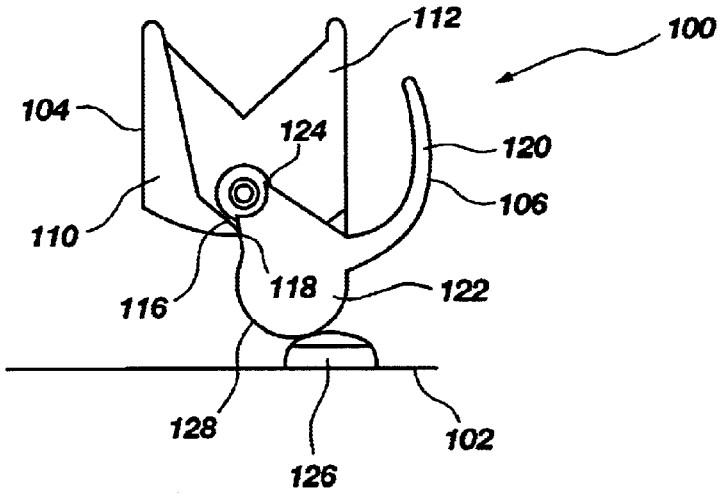
FIG. 2B is an end view of the clamping arrow rest shown in FIG. 2A in a second pre-launch position.

Referring now to FIGS. 2A and 2B, the distal end of an clamping arrow rest, generally indicated at 100, in accordance with the principles of the present invention shown in a first resting position (FIG. 2A) and a second pre-launch position (FIG. 2B) relative to the shelf 102 of the bow riser. The arrow rest 100 is comprised of a base portion 104 for supporting the shaft of an arrow (not shown) and a pivotable camping member 106 that is rotatably coupled to the base portion 104 and biased relative to the base portion 104 in a direction to encourage rotation of the clamping member 106 from its position shown in FIG. 2A to its position in FIG. 2B.

The base portion defines a longitudinally extending slot 108 in the form of a V for supporting the shaft of an arrow. A projected portion 110 extends from the distal end 112 of the base portion 108 so as to provide an abutment surface 114 for engaging with a surface 118 of the clamping member 106 to prevent over rotation of the clamping member 106 relative to the base portion 104.

The clamping member 106 is comprised of an arcuate clamping portion 120 a bulbous shaped abutment portion 122 and an attachment portion 124 having a bore extending there through for attachment to the base potion 104. An abutment member 126 is attached to the shelf 102 for abutting the abutment portion 122 as the arrow rest 100 moves from its pre-launch position back to the resting position to cause the clamping member 106 to from an open position back to a closed/grasping position. As shown in FIG. 2A. The rounded surface 128 of the clamping member 106 slides along the abutment member 126 as the arrow rest 100 drops. When the clamping member 106 is positioned relative to the abutment member 126 as shown in FIG. 2A, the clamping member 106 is "locked" in place such that manual rotation of the clamping member 106 is prevented by the abutment member 126.

By forming the clamping member 106 from a flexible material such as a rubber or plastic, the gap 130 between the clamping portion 120 ad the base 104 can be increased to allow manual insertion of removal of a shaft of an arrow without having to rotate the clamping member 106 relative to the base 104. The clamping portion 120, however, is rigid enough to hold the shaft of an arrow in the channel 108 and help prevent the arrow shaft from becoming inadvertently disengaged from the arrow rest 100. Also, by facing the gap 130 toward the surface of the riser (FIG. 1A), if the shaft of an arrow does become dislodged from the clamping member 106, the arrow will likely fall between the arrow rest 100 and the riser without falling to the ground.

Figure 3:
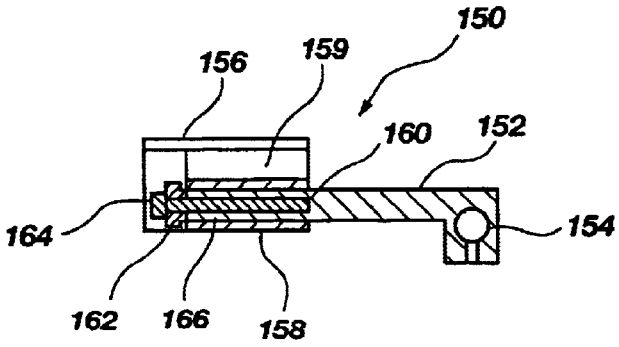
FIG. 3 is a cross-sectional side view of an arrow rest support arm in accordance with the principles of the present invention.

FIG. 3 is a cross-sectional side view of an arrow rest arm, generally indicated at 150 in accordance with the principles of the present invention. The arm 150 includes an elongate attachment member 152 defining an aperture 154 for receiving a shaft for rotation of the arm 150 relative thereto. The attachment member 152 is attached to an arrow supporting member 156 that is slid onto the distal end 158 of the arm 152. The arrow supporting member 156 provides a longitudinally extending channel or slot 159 within which the shaft of an arrow can at least partially reside therein. A clamping member 162 is coupled to the supporting member 156 with a threaded fastener 164 that extends through the clamping member 162 and threadedly engages the arm 152. A biasing member 166, such as a coil spring, is positioned on the shaft of the threaded fastener 164 and biases the clamping member 162 relative to the supporting member 156. to encourage clamping of the shaft of an arrow relative to the supporting member 156.

Figure 4:
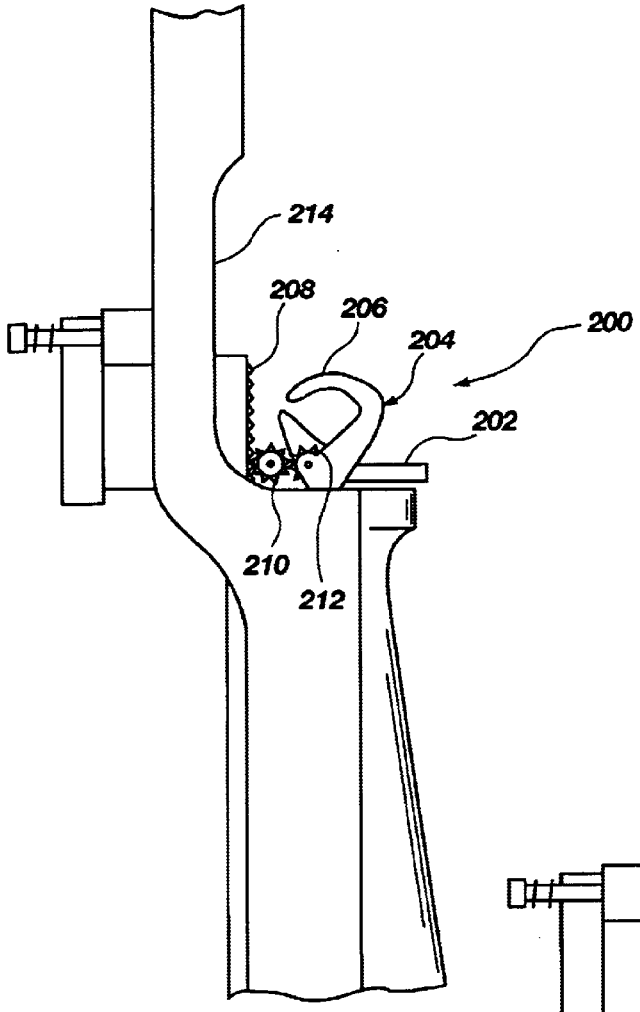
FIG. 4 is a partial front view of a compound bow with a second embodiment of an arrow rest attached thereto in accordance with the principles of the present invention.

FIG. 4 illustrates another embodiment of an arrow rest, generally indicated at 200 configured for clamping the shaft of an arrow (not shown) relative thereto and releasing the shaft of the arrow when the arrow is in a position to be launched. The actuation of the arrow rest 200 is provided by a mechanism configured similarly to that shown in FIG. 1A, that is by rotation of a shaft 202 to cause pivotal rotation of the arrow rest arm 204 relative thereto. In this embodiment, however, the arrow rest is provided with a clamping member 206 that is actuated by a rack 208 and pinion gear 210 that engages with gear teeth 212 provided on the clamping member 206. The pinion gear 210 is an idle gear (i.e., freely rotatable) that is coupled to the arm 204 and moves therewith. The rack 208 is attached to the riser 214 and may be positioned at a slight angle to match the angular rotation of the pinion gear 210 as it pivots upwardly with the arm 204. As the pinion gear 210 is lifted the pinion gear 210 will rotate relative to the rack 208 causing the clamping member 206 to open. As the pinion gear 210 moves down the rack 208, the engagement with the teeth 212 on the clamping member 206 will cause the clamping member 206 to become closed as illustrated. Thus, both opening and closing of the clamping member 206 is actuated by the pinion gear 210. Of course, those of skill in the art will appreciate after understanding the principles of the present invention that many other mechanisms may be employed to provide a clamping feature relative to the arrow rest for grasping the shaft of an arrow when the arrow is in a resting position. The present invention in intended to cover each and every variation of the present invention and equivalents thereof.

Figure 5:
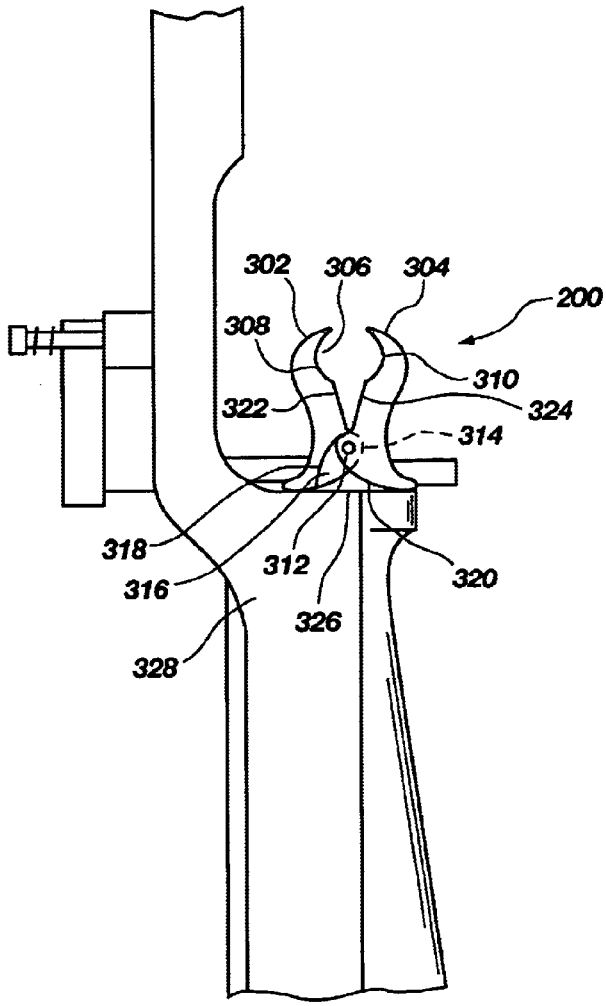
FIG. 5 is a partial front view of a compound bow with a third embodiment of an arrow rest attached thereto in accordance with the principles of the present invention.

For example, as shown in FIG. 5, the clamping arrow rest, generally indicated at 300 is comprised of a pair of scissor type clamping members 302 and 304 that define a central aperture 306 therein between for receiving an holding the shaft of an arrow. As such, each clamping member 302 and 304 defines a crescent shaped recess 308 and 310, respectively, for engaging the sides of the shaft of an arrow. The clamping members 302 and 304 are biased relative to one other in a direction that encourages separation of the recesses 308 and 310. In addition, the clamping member 302 and 304 can rotate relative to each other about a central shaft 312. A biasing device 314, such as a coil spring, is provide on the shaft 312 to bias the clamping members 302 and 304 into an open position. The clamping member 302 is provided with a recess 316 that defines and abutment surface 318 for abutting against the arcuate surface 320 of the clamping member 304. When the surface 320 is engaged against the surface 318, the clamping members 302 and 404 are in an open position. The surface 322 and 324 then define a V-shaped notch for supporting the shaft of an arrow.

As the arrow rest returns to a resting position in which the legs of the clamping members 302 and 304 engage the shelf 326 of the riser 328, the curved surfaces of the legs, such as surface 320, slide along the shelf 326 until the bases of the surface 322 and 324 abut to hold the clamping members slightly apart as shown.

Figure 6A:
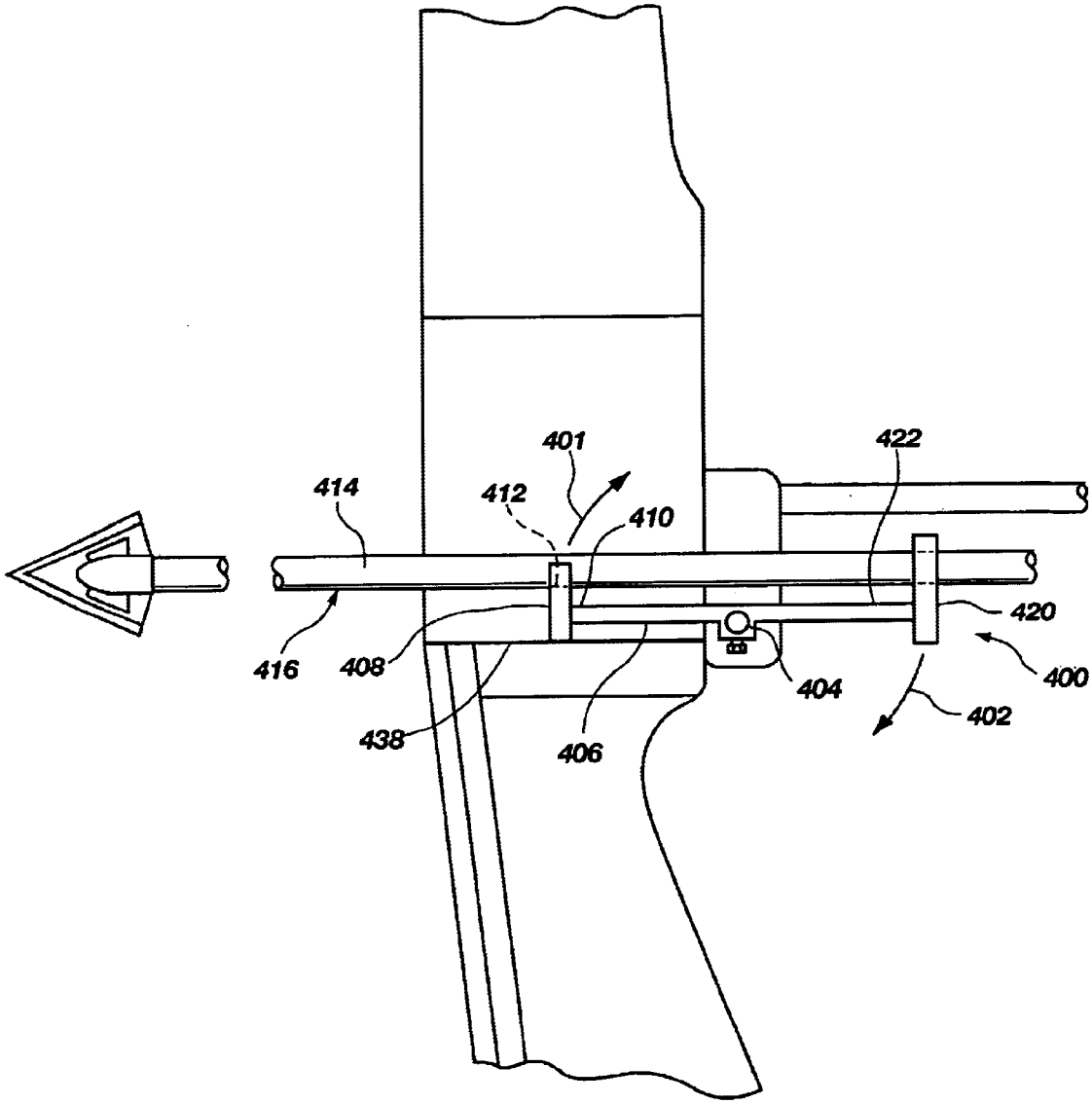
FIG. 6A is a partial side view of a compound bow with a fourth embodiment of an arrow rest attached thereto in accordance with the principles of the present invention.
Figure 6B:
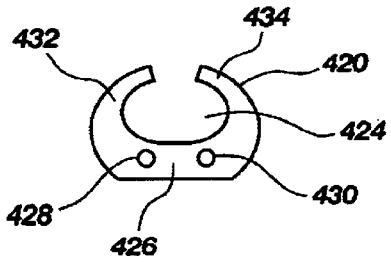
FIG. 6B is a front view of the clamping mechanism of the arrow rest illustrated in FIG. 6A.

In FIG. 6A, an arrow rest, generally indicated at 400, is caused to pivot as indicated by arrows 401 and 402 about a rotatable shaft 404. An arrow rest arm 406 is attached to the shaft 404. The arm 406 extends on both sides of the shaft 404. A shaft support 408 is attached to the distal end 410 of the arm 406 and defines a channel 412 for supporting the shaft 414 of an arrow 416. A clamping device 420 is attached to the proximal end 422 of the arm 406. As shown in FIG. 6B, the clamping device 420 is a C shaped member when turned on its side to define a partially enclosed central aperture 424 for receiving the shaft 414 of an arrow 416. The base 426 of the device 420 is provided with a pair of bores 428 and 430 for receiving threaded fasteners to attach the device 420 to the distal end 422 of the arm 406. A similar means of attachment may be employed for attaching the shaft support 408 to the proximal end 410. A pair of crescent shaped arms portions 432 and 434 further define the aperture 424 and are spaced apart at their tips to allow insertion and removal of the shaft 414 of the arrow 416 while securing the shaft 414 in the aperture 424 to prevent the shaft 414 from simply falling out if the device 420 becomes inverted. The device 420 is formed from a soft flexible material such as rubber, foam rubber or foam.

As the arrow rest arm 406 rotates in the direction of arrows 401 and 402, the shaft support 408 will lift the shaft 414 relative the to the shelf 438 of the riser. As the shaft 414 is lifted and the clamping device 420 lowers, the shaft 414 will be pulled from engagement with clamping device 420 to be free to be launched. When the arrow 416 is released, the arm 406 is biased to return the support 408 to engage the shelf 438 as shown. The rotation of the arm 406, however, is timed so as to allow the fletching (not shown) of the arrow 416 to pass by the clamping device 420 before the clamping device 420 moves back to a position where it may impact the fletching as it passes the clamping device 420.

Figure 7:
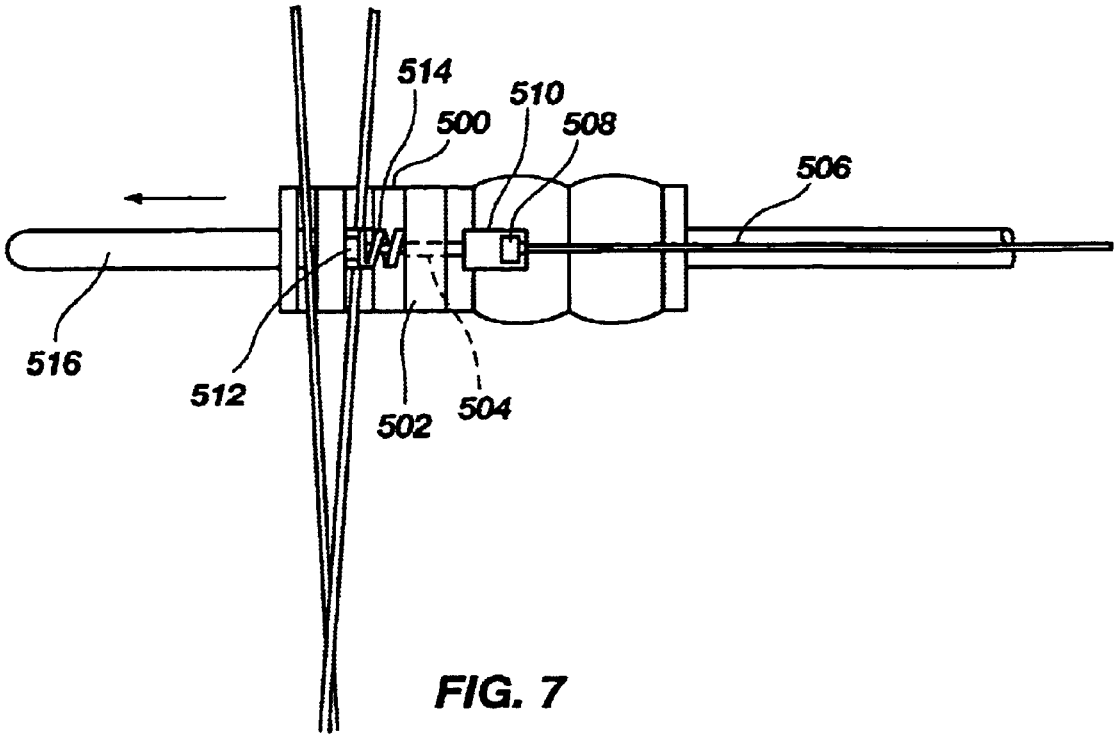
FIG. 7 is a side view of a second embodiment of a cable guide assembly in accordance with the principles of the present invention.
Figure 8:
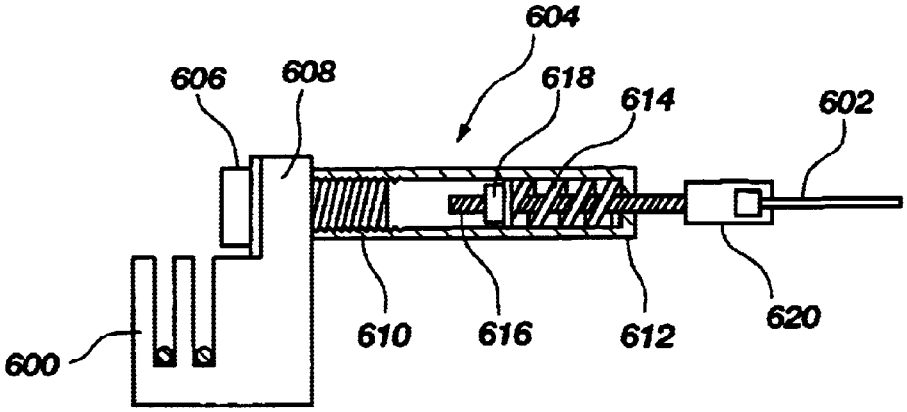
FIG. 8 is a side view of a third embodiment of a cable guide assembly in accordance with the principles of the present invention.

Finally, as shown in FIG. 7 and FIG. 8, the arrow rest (as previously described) may be coupled to a cable slide with various linkage devices that provide some delay in actuation of the arrow rest relative to movement of the cable slide as an arrow is drawn. As previously discussed, such delay, while not essential, allows the arrow rest to move out of the way of the arrow before the fletching of the arrow passes the arrow rest. In FIG. 7, the cable slide 500 is provided with a mounting portion 502 that defines a transversely extending bore 504. A cable 506 (which is coupled to the arrow rest) is secured with a cable stop 508 that is crimped to the end of the cable 506. The stop 508 is inserted into a coupling device 510 that defines a recess for holding the stop 508 therein and a threaded bore on the other end for receiving a threaded fastener 512. The fastener 512 is provided with a coil spring 514 that biases the head of the fastener 512 relative to the mounting portion 502. The fastener 512 extends through the bore 504 and into the coupler 510. As the cable slide 500 slides along the cable guide 516 in the direction of the arrow, the spring 514 will be compressed to some degree before the cable 506 is moved, thus providing the aforementioned delay.

Similarly, in FIG. 8, a cable slide 600 is coupled to a cable 602 with a linkage mechanism 604 that includes a threaded fastener 606 inserted through a mounting portion 608 of the cable slide 600 and engages an internally threaded tube-like member 610. The distal end 612 of the tube 610 is inwardly turned to provide an abutment surface for holding a spring 614 disposed around a threaded shaft 616. A nut 618 is threaded onto the proximal end of the shaft 616 and can be adjusted to any point along the shaft to allow for adjustability of the linkage mechanism 604 for the particular bow configuration. The shaft 616 is threaded into a coupler 620 having a similar configuration to the coupler 510 shown in FIG. 7. As the cable slide 600 moves to apply tension in the cable 602, the spring 614 allows for movement of the slide 600 and the tube 610 before the cable 602 is moved along with movement of the cable slide 600.

Figure 9:
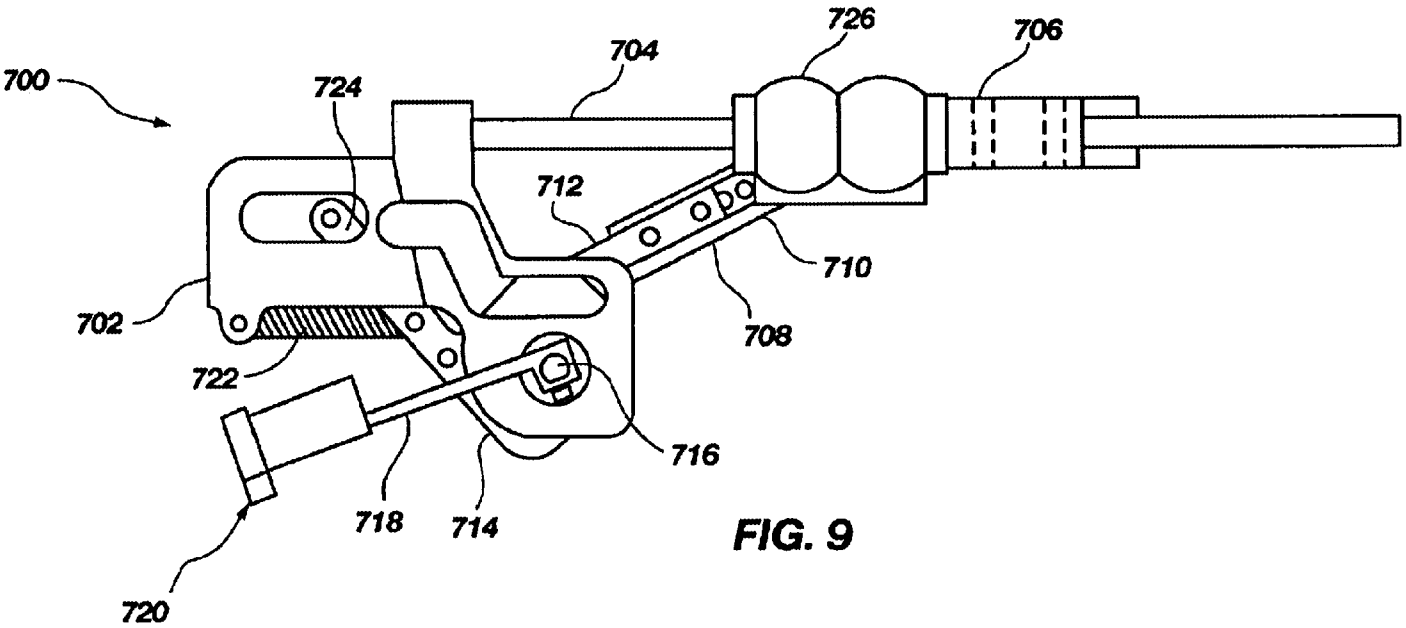
FIG. 9 is a side view of a fifth embodiment of an arrow rest in accordance with the principles of the present invention.

FIG. 9 illustrates yet another embodiment of a self-clamping arrow rest, generally indicated at 700, in accordance with the present invention. The arrow rest 700 is comprised of a mounting bracket 702 for mounting the arrow rest 700 relative to the riser of a bow (not shown). A cable guide 704 is attached to the bracket 702. A cable slide 706 for receiving the tuning cables of a compound bow is positioned on and slidable relative to the cable guide. The cable slide 706 is coupled to an adjustable linkage member 708 that is comprised of first and second components. 710 and 712 that can be pinned or otherwise fastened together at discrete points to allow for adjustment of the length of the linkage member 708.

The linkage member 708 is also coupled at its opposite end to a pivotable member 714 that is rotatably coupled to the bracket 702 by an elongate shaft 716 that extends through the bracket 702 and is rotatable relative thereto. On the other side of the bracket 702 from the pivotable member 714, an arrow rest arm 718 is attached to the shaft 716. The arrow rest arm 718 includes a clamping/shaft support assembly 720 that is configured to grasp the shaft of an arrow when the arm 718 is in a resting position and to release the shaft of the arrow when the arm 718 is raised. A biasing member 722 in the form of a coil spring is interposed and connected between the mounting bracket 702 and the pivotable member 714 so as to encourage rotation of the shaft 716 in a counter-clockwise direction and thus downward biasing of the support assembly 720.

The pivotable member 714 is provided with an arm portion 724 having a plurality of attachment points thereon in the form of holes for allowing selective attachment at discrete points of the linkage member 708 relative thereto. A rubber stop 726 is positioned on the cable guide 704 to allow the cable slide 706 to abut there against when the tuning cables are in a resting position.

Figure 10:
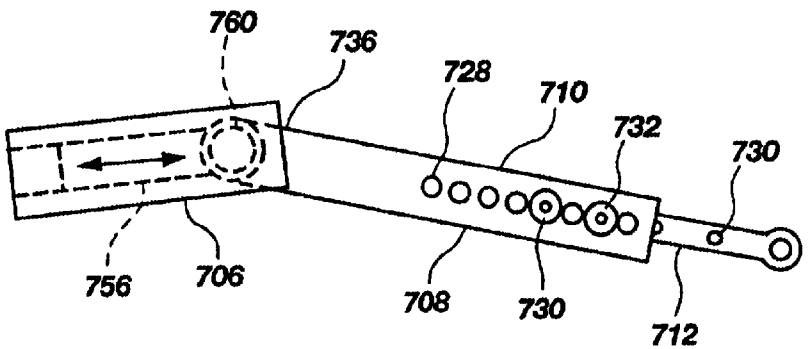
FIG. 10 is a side view of the linkage mechanism of the arrow rest shown in FIG. 9.

As further illustrated in FIG. 10, the first and second components 710 and 712 of the linkage member 708 are provided with a plurality of holes, such as holes 728 and 730, to allow for selective attachment of the two components as with fasteners 732 and 734. The distal end 736 of the linkage member 708 fits within the cable slide 706, and as will be described further, provides a delay as the linkage member 708 can move or slide as indicated by the arrow relative to the cable slide 706 a certain distance within the slot or channel 756 without causing corresponding movement of the cable slide 706 until it abuts the end 760 of the channel 756. At that point, the cable slide 706 will move with the linkage member 708. In a resting position, the linkage member 708 with be positioned within the channel 756 away from the end 760. As the cable of the bow is drawn, the cable slide 706 can move away from the linkage member 708 a distance to cause a delayed reaction in movement between the cable slide 706 and the linkage member 708 until the end 736 of the linkage member 708 abuts the end 760 of the channel 756. This provides the proper timing for bow stroke.

Figure 11:
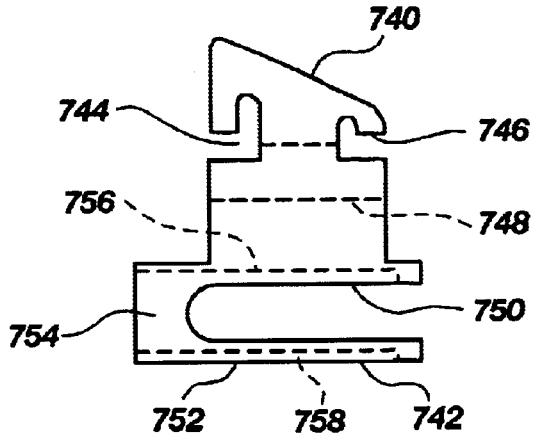
FIG. 11 is a top view of the cable slide of the arrow reset shown in FIG. 9.

As further illustrated in FIG. 11, the cable slide is comprised of a cable retention portion 740 integrally formed with a linkage maintaining portion 742. The cable retention portion 740 is provided with two channels 744 and 746 for retaining and holding the tuning cables relative thereto. Each channel 744 and 746 has an L shape so as to help maintain the tuning cables therein. A transversely extending bore 748 is provided for receiving the cable guide 704.

Figure 12:
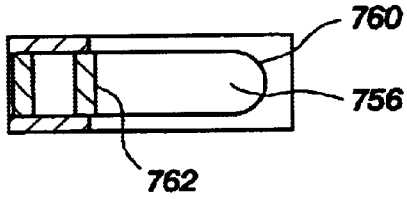
FIG. 12 is a cross-sectional side view of the cable slide shown in FIG. 11.

The linkage maintaining portion 742 is defined by a pair of side walls 750 and 752 held relative to one another by a connecting portion 754. The side walls 750 and 752 define opposing channels 756 and 758, respectively. As shown in FIG. 12, the channel 756 extends partially along the side wall 750 so as to terminate therein to define an abutment end 760. A rubber stopper 762 is positioned on the opposite end of the abutment end 760 so as to retain the end of the linkage member 708 therein.

Figure 13:
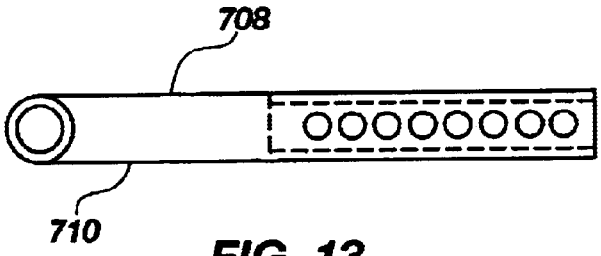
FIG. 13 is a side view of a component of the linkage mechanism shown in FIG. 10.
Figure 14:
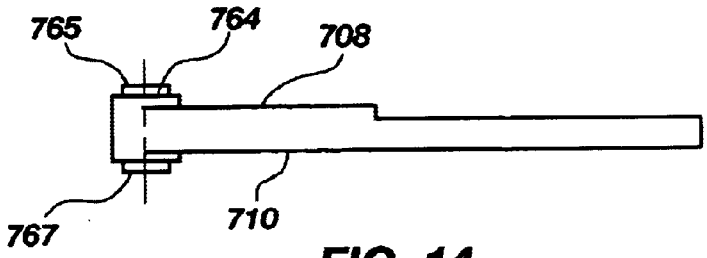
FIG. 14 is a top view of the linkage mechanism component shown in FIG. 13.

As shown in FIGS. 13 and 14, one component 710 of the linkage member 708 is comprised of an elongate member having a cylindrical end portion 764 that extends laterally outwardly from the component 710. The end portion 764 includes a pair of cylindrical protrusions 765 and 767 laterally extending therefrom configured for being slidably received within the channels 756 and 758. Moreover, the spacing between the side walls 750 and 752 is such that the cylindrical portion protrusions 765 and 767 are held therein when inserted. Because of the length of the channels 756 and 758 relative to the diameter of the portions 765 and 767, the portions 765 and 767 can slide a distance along the channels 756 and 758 to allow movement of the cable slide 706 relative to,the component 710 before the portion 764 engages with the end 760 such that further movement of the cable slide 706 will cause corresponding movement of the linkage 708. Such delay in movement of the linkage 708 relative to the cable slide 706 requires a certain amount of draw on the cable of the bow before the arm 718 raises and the clamping assembly releases the shaft of the arrow. Furthermore, at release of the arrow, the delay allows the arrow to become airborne before dropping away to allow the fletching or vanes of the arrow pass the arrow rest without contacting the clamping/support assembly 720.

Figure 15:
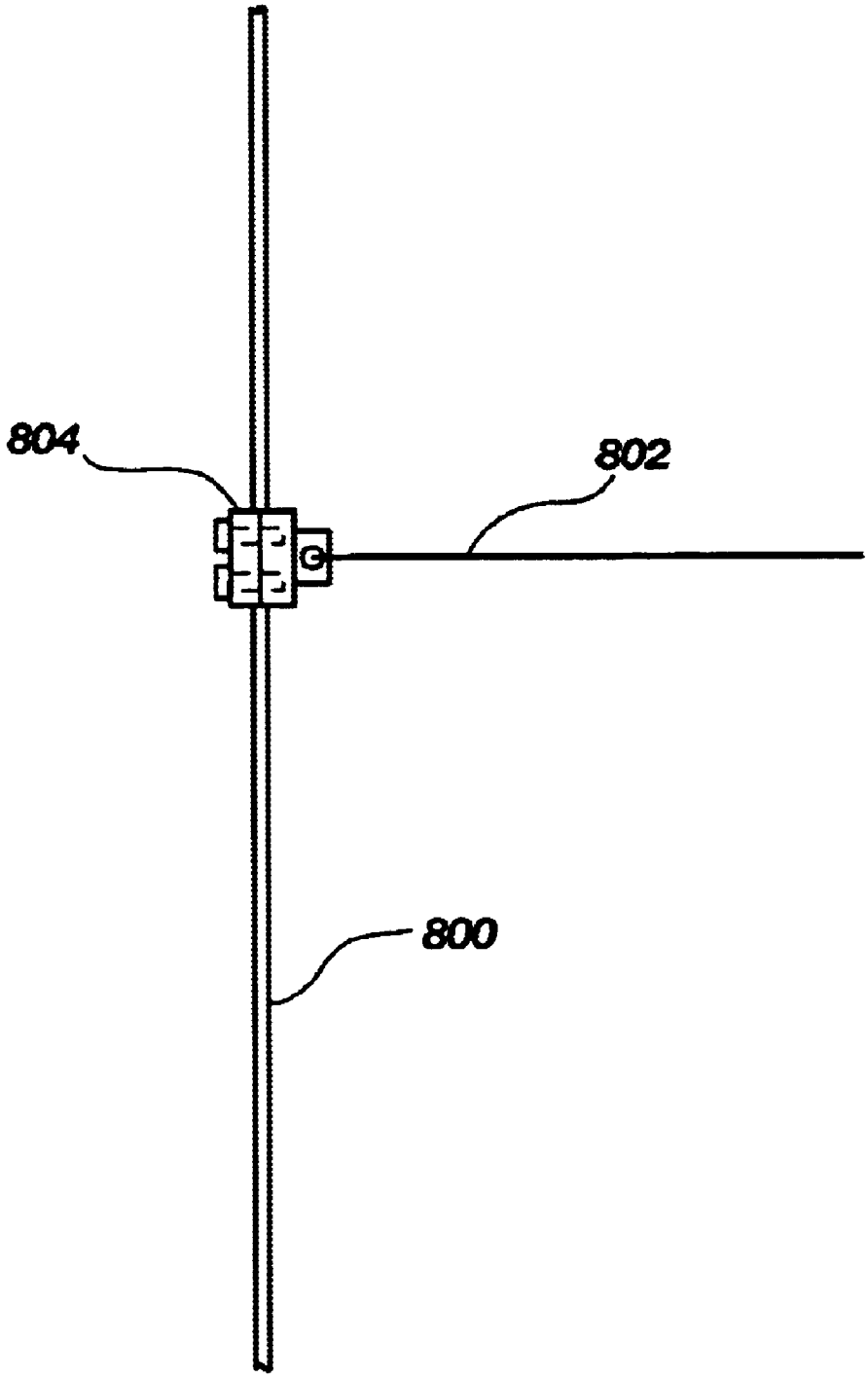
FIG. 15 is an alternative embodiment of a means for linking the arrow rest of the present invention to the cable system of a bow in accordance with the principles of the present invention.
Figure 16A:
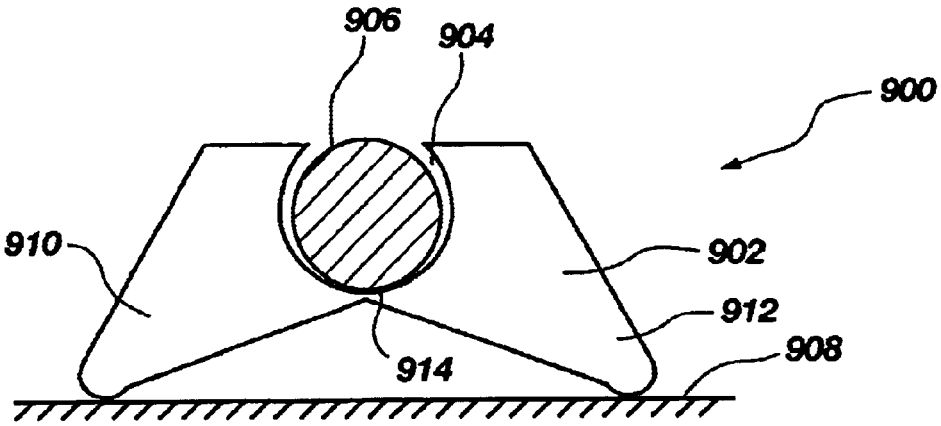
FIG. 16A is an front view of a sixth embodiment of an arrow rest in accordance with the principles of the present invention.
Figure 16B:
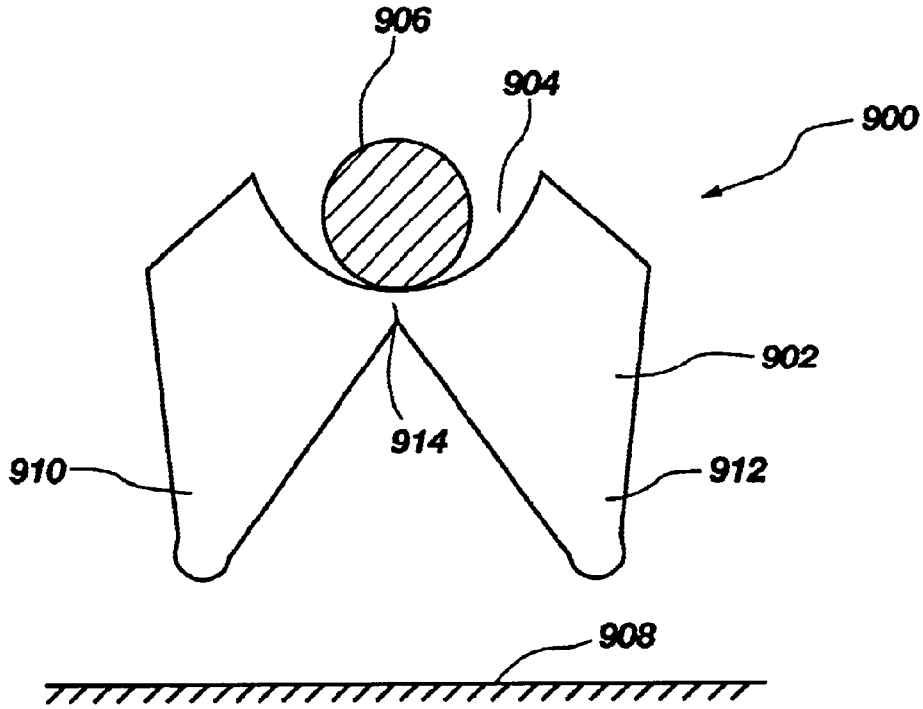
FIG. 16B is a front view of the arrow rest of FIG. 16A in a raised position.

While the apparatus of the present invention has been described with reference to certain embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. For example, as shown in FIG. 15 the arrow rest could be linked to one of the cable spans without using the cable slide by attaching the linkage mechanism 802 directly to the cable 800. Thus, a bracket or clamping device 804 fastened around the cable 800 could be attached directly to the cable 800 with the linkage mechanism 802 attached to the bracket or clamping device 804. Thus, the cable guide need not be attached to the mounting bracket and the arrow rest of the present invention can work independently of the cable guide and/or cable slide. In another example as shown in FIGS. 16A and 16B, the clamping mechanism 900 of the arrow rest according to the principles of the present invention is comprised of a single piece member 902 formed from a flexible material, such as rubber or plastic. The member 902 defines an shaft grasping recess 904 for grasping the shaft 906 of an arrow when the member 902 is in contact with the riser shelf 908 or other abutment of a bow. The member includes a pair of legs 910 and 912 separated by a thinned portion 914 that functions essentially as a hinge between the two leg portions 910 and 912. As the member 902 is lifted from the shelf 908, the leg portions 910 and 912 are drawn together by the natural biasing force of the material from which the member 902 is formed. That is, the member 902 is formed to be shaped as shown in FIG. 16B and is forced into its shape shown in FIG. 16A by contact with the shelf 908. Thus, as the bottoms of the leg portions 910 and 912 contact the shelf 908, the legs are caused to spread apart which in turn causes the recess 904 to close around the shaft 906. The bottoms of the leg portions 910 and 912 are rounded to encourage the legs to spread when contacting the shelf 908. The opening of the top of the recess 904 is such that the shaft 906 can be inserted into the recess 904 when the arrow rest 900 is in the position shown in FIG. 16A. Once inserted into the recess 904, the shaft 906 is held within the recess 904 by the top edges of the recess 904. With some effort, however, the shaft 906 can be removed from the recess 904 if desired. As the member 902 moves from the position shown in FIG. 16A to the position shown in FIG. 16B, the arrow member opens the recess 904 to cradle the shaft 906 without obstructing its ability to be launched by the bow from the arrow rest 900. The claims provided herein are intended to cover such modifications and combinations and all equivalents thereof. Reference herein to specific details of the illustrated embodiments is by way of example and not by way of limitation.

What is claimed is:

1. An arrow rest, comprising:

a mounting bracket configured for attaching to a bow;

an arm coupled to said mounting bracket being pivotable relative thereto from a resting position to a pre-launch position, said arm positioned to support a shaft of an arrow relative thereto when said arm is in said pre-launch position;

a clamping mechanism secured to said arm for holding a shaft of an arrow when said arm is in said resting position and releasing the shaft when said arm is in said pre-launch position; and a linkage mechanism configured for linking said arm to a cable of a bow.

2. The arrow rest of claim 1, further comprising an elongate shaft rotatably coupled to the mounting bracket and attached to the arm.

3. The arrow rest of claim 2, further comprising a pivotable member fixedly attached to said shaft and coupled to said linkage mechanism whereby movement of said linkage mechanism causes rotation of said pivotable member and rotation of said shaft relative to said mounting bracket.

4. The arrow rest of claim 3, wherein said arm and said pivotable member are on opposite sides of said mounting bracket with said shaft extending on both sides of said mounting bracket.

5. The arrow rest of claim 3, further including a biasing member for biasing said pivotable member relative to said mounting bracket to bias said arm toward said resting position.

6. The arrow rest of claim 1, further including an arrow support member attached to said arm, said arrow support member defining a slot for at least partially receiving a shaft of an arrow.

7. The arrow rest of claim 6, wherein said clamping mechanism is configured to cooperate with said support member for holding the shaft of the arrow relative to said support member when said arm is in said resting position.

8. The arrow rest of claim 1, wherein said clamping mechanism comprises a clamping member having a first portion for holding the shaft of an arrow and a second portion for engaging with an abutment surface to return said clamping member to a clamping position as said arm moves from said pre-launch position to said resting position.

9. The arrow rest of claim 8, wherein said clamping mechanism is biased relative to said arm to an open position so as to automatically open when said arm moves to a pre-launch position.

10. The arrow rest of claim 1, wherein said clamping mechanism comprises a gear assembly for actuating said clamping mechanism from a closed position to an open position as said arm moves from said resting position to said pre-launch position.

11. The arrow rest of claim 10, wherein said gear assembly comprises a rack and pinion gear, said pinion gear engaging teeth on a clamping member for opening and closing said clamping member relative to said arm.

12. The arrow rest of claim 1, wherein said clamping mechanism comprises a pair of clamping members pivotally coupled together so as to grasp a shaft of an arrow when said arm is in said resting position and to release yet support the shaft of the arrow when the arm is in the pre-launch position.

13. The arrow rest of claim 12, wherein said pair of clamping members are biased relative to one another into an open position and are forced to a closed position by abutting against an abutment structure when the arm is moved to the resting position.

14. The arrow rest of claim 1, wherein said clamping mechanism comprises a clamping member secured to a first end of a pivotable arm and a shaft support member secured to a second end of a pivotable arm, said arm being pivotable at a point between said first end and said second end, said clamping member engaging the shaft of an arrow when said arm is in said resting position and releasing the shaft as the arm is rotated causing the shaft support member to lift the shaft of the arrow from the clamping member.

15. The arrow rest of claim 1, wherein said linkage mechanism comprises a linkage member coupled between said arm and a cable slide.

16. The arrow rest of claim 15, wherein said linkage member is resilient.

17. The arrow rest of claim 15, wherein said linkage member comprises a cable coupled to a biasing member for providing bias in said cable.

18. The arrow rest of claim 17, further including a cable adjustment mechanism for adjusting the effective length of the cable between the mounting bracket and the cable slide.

19. The arrow rest of claim 15, further including a stop attached to a cable guide for abutting against said cable slide when said cable slide is in a resting position.

20. The arrow rest of claim 15, wherein said cable slide comprises a linkage receiving portion for receiving a linkage member, said cable slide capable of moving a distance relative to said linkage member before causing a corresponding movement of said linkage member.

21. The arrow rest of claim 20, wherein said linkage member is comprised of first and-second components selectively securable relative thereto for adjusting the length of said linkage member.

22. The arrow rest of claim 1, wherein said linkage mechanism comprises a linkage member coupled between said arm and a cable bracket.

23. An arrow rest, comprising:

a mounting bracket configured for attaching to the riser of a compound bow;

a cable guide attached to the mounting bracket;

a cable slide slidably secured to the cable guide and configured for engaging the cable of a compound bow;

an arm coupled to the mounting bracket being pivotable relative thereto from a resting position to a pre-launch position, said arm positioned to support the shaft of an arrow relative thereto when the arm is in said pre-launch position; and a linkage mechanism coupled between said cable slide and said arm for causing movement of said arm from said resting position to said pre-launch position as the cable of the bow is drawn.

24. The arrow rest of claim 23, further including a clamping mechanism coupled to said arm for holding the shaft of an arrow when the arm is in the resting position.

25. The arrow rest of claim 24, wherein said clamping mechanism is configured to cooperate with a support member for holding the shaft of the arrow relative to said support member when said arm is in said resting position.

26. The arrow rest of claim 24, wherein said clamping-mechanism comprises a clamping member having a first portion for holding the shaft of an arrow and a second portion for engaging with an abutment surface to return said clamping member to a clamping position as said arm moves from said pre-launch position to said resting position.

27. The arrow rest of claim 26, wherein said camping mechanism is biased relative to said arm to an open position so as to automatically open when said arm moves to a pre-launch position.

28. The arrow rest of claim 24, wherein said clamping mechanism comprises a gear assembly for actuating said clamping mechanism from a closed position to an open position as said arm moves from said resting position to said pre-launch position.

29. The arrow rest of claim 28, wherein said gear assembly comprises a rack and pinion gear, said pinion gear engaging teeth on a clamping member for opening and closing said clamping member relative to said arm.

30. The arrow rest of claim 24, wherein said clamping mechanism comprises a pair of clamping members pivotally coupled together so as to grass a shaft of an arrow when said arm is in said resting position and to release yet support the shaft of the arrow when the arm is in the pre-launch position.

31. The arrow rest of claim 30, wherein said pair of clamping members are biased relative to one another into an open position and are forced to a closed position by abutting against an abutment structure when the arm is moved to the resting position.

32. The arrow rest of claim 24, wherein said clamping mechanism comprises a clamping member secured to a first end of a privotable arm and a shaft support member secured to a second end of a pivotable arm, said arm being pivotable at a point between said first end and said second end, said clamping member engaging the shaft of an arrow when said arm is in said resting position and releasing the shaft as the arm is rotated causing the shaft support member to lift the shaft of the arrow from the clamping member.

33. The arrow rest of claim 23, further comprising an elongate shaft rotatably coupled to the mounting bracket and attached to the arm.

34. The arrow rest of claim 33, further comprising a pivotable member fixedly attached to said shaft and coupled to said linkage mechanism whereby movement of said linkage mechanism causes rotation of said pivotable member and rotation of said shaft relative to said mounting bracket.

35. The arrow rest of claim 34, wherein said arm and said pivotable member are on opposite sides of said mounting bracket with said shaft extending on both sides of said mounting bracket.

36. The arrow rest of claim 34, further including a biasing member for biasing said pivotable member relative to said mounting bracket to bias said arm toward said resting position.

37. The arrow rest of claim 23, further including an arrow support member attached to said arm, said arrow support member defining a slot for at least partially receiving a shaft of an arrow.

38. The arrow rest of claim 23, wherein said linkage mechanism comprises a linkage member coupled between said arm and a cable slide.

39. The arrow rest of claim 38, wherein said linkage member is resilient.

40. The arrow rest of claim 38, further including a stop attached to a cable guide for abutting against said cable slide when said cable slide is in a resting position.

41. The arrow rest of claim 23, wherein said linkage mechanism comprises a linkage member coupled between said arm and a cable bracket.

42. The arrow rest of claim 41, wherein said linkage member comprises a cable coupled to a biasing member for providing bias in said cable.

43. The arrow rest of claim 42, further including a cable adjustment mechanism for adjusting the effective length of the cable between the mounting bracket and the cable slide.

44. The arrow rest of claim 23, wherein said cable slide comprises a linkage receiving portion for receiving a linkage member, said cable slice capable of moving a distance relative to said linkage member before causing a corresponding movement of said linkage member.

45. The arrow rest of claim 44, wherein said linkage member is comprised of first and second components selectively securable relative thereto for adjusting the length of said linkage member.

46. An arrow rest, comprising:

means for supporting the shaft of an arrow relative to the riser of a compound bow;

means for moving said means for supporting from a resting position to a pre-launch position as the cable of the compound bow is drawn; and means for clamping the shaft of the arrow relative to the means for supporting when the means for supporting is in the resting position and releasing the shaft of the arrow when the means for supporting is in the pre-launch position.

47. The arrow rest of claim 46, wherein said means for supporting comprises an arm being pivotable from a resting position to a pre-launch position, said arm positioned to support a shaft of an arrow relative thereto.

48. The arrow rest of claim 46, further comprising means for linking said means for supporting to a cable of a bow.

49. The arrow rest of claim 48, wherein said means for linking further comprises a means for biasing said means for linking relative to said means for supporting.

50. The arrow rest of claim 48, further comprising means for adjusting said means for linking for adjusting the effective length of said means for liking relative to a particular bow configuration.

51. The arrow rest of claim 48, wherein said means for linking further comprises means for allowing a partial draw of a bow before causing a corresponding movement of said means for linking.

52. The arrow rest of claim 48, wherein said means for linking further comprises means for adjusting a length of said means for linking.

53. The arrow rest of claim 46, further comprising means for mounting said means for supporting to the riser of a bow.

54. The arrow rest of claim 46, further including a means for biasing said means for supporting to a resting position.

* * * * *